US010451294B2

(12) United States Patent
Lee et al.

(10) Patent No.: US 10,451,294 B2
(45) Date of Patent: Oct. 22, 2019

(54) MACHINE LEARNING BASED SMART WATER HEATER CONTROLLER USING WIRELESS SENSOR NETWORKS

(71) Applicant: Santa Clara University, Santa Clara, CA (US)

(72) Inventors: Hohyun Lee, Santa Clara, CA (US); Russell Williams, Hailey, ID (US); Rachel Donohoe, Juneau, AK (US); Rebecca Barney, Albuquerque, NM (US); Kerbasi Ugarte, San Jose, CA (US); Xavier Moya, Albuquerque, NM (US); Alex Zatopa, San Francisco, CA (US)

(73) Assignee: Santa Clara University, Santa Clara, CA (US)

( * ) Notice: Subject to any disclaimer, the term of this patent is extended or adjusted under 35 U.S.C. 154(b) by 146 days.

(21) Appl. No.: 14/799,146

(22) Filed: Jul. 14, 2015

(65) Prior Publication Data

US 2016/0010878 A1 Jan. 14, 2016

Related U.S. Application Data

(60) Provisional application No. 62/024,376, filed on Jul. 14, 2014.

(51) Int. Cl.
*F24D 19/10* (2006.01)

(52) U.S. Cl.
CPC ..... *F24D 19/1051* (2013.01); *F24D 19/1063* (2013.01)

(58) Field of Classification Search
CPC ..... F24D 19/1051; F24D 19/1063
USPC ..... 700/300
See application file for complete search history.

(56) References Cited

U.S. PATENT DOCUMENTS

| | | | | |
|---|---|---|---|---|
| 4,620,667 | A * | 11/1986 | Vandermeyden | G05D 23/1917 122/13.3 |
| 6,059,192 | A * | 5/2000 | Zosimadis | E03C 1/041 236/12.12 |
| 6,293,471 | B1 | 9/2001 | Stettin et al. | |
| 8,461,493 | B1 | 1/2013 | Cantolino et al. | |
| 8,590,802 | B2 | 11/2013 | Hammerstrom | |
| 2007/0179678 | A1* | 8/2007 | Nordberg | G05D 23/1917 700/300 |
| 2012/0031498 | A1* | 2/2012 | Carmel | F24D 17/0078 137/2 |
| 2012/0118989 | A1 | 5/2012 | Buescher et al. | |
| 2012/0271465 | A1* | 10/2012 | Zobrist | G05D 23/19 700/282 |
| 2013/0036311 | A1* | 2/2013 | Akyol | H04L 63/08 713/189 |

(Continued)

*Primary Examiner* — Kenneth M Lo
*Assistant Examiner* — Michael W Choi
(74) *Attorney, Agent, or Firm* — Lumen Patent Firm

(57) ABSTRACT

Smart hot water heater control can be improved by departing from the conventional approach of monitoring hot water demand at a single point (i.e., the water heater output). Instead, hot water demand is monitored at each location in the building where hot water is used. With this approach, the controller can provide hot water at a temperature suitable for the intended use, e.g., warm water for a bath or shower, and much hotter water for a dishwasher. This advantageously avoids inefficiency due to mixing hot and cold water at a tap to provide temperature control.

11 Claims, 10 Drawing Sheets

(56) References Cited

U.S. PATENT DOCUMENTS

| | | | | |
|---|---|---|---|---|
| 2013/0197827 | A1* | 8/2013 | Besore | G06Q 50/06 702/45 |
| 2013/0299600 | A1 | 11/2013 | Beckers | |
| 2014/0229022 | A1* | 8/2014 | Deivasigamani | G05D 7/0629 700/282 |
| 2014/0277817 | A1* | 9/2014 | Stevens | G05D 23/1917 700/300 |
| 2014/0348453 | A1* | 11/2014 | Bartl | F16C 37/007 384/476 |
| 2014/0348638 | A1* | 11/2014 | Bartl | F01D 1/04 415/116 |
| 2015/0131977 | A1* | 5/2015 | Beckers | G05D 23/1904 392/441 |

* cited by examiner

MACHINE LEARNING BASED SMART WATER HEATER CONTROLLER USING WIRELESS SENSOR NETWORKS

CROSS REFERENCE TO RELATED APPLICATIONS

This application claims the benefit of U.S. provisional patent application 62/024,376, filed on Jul. 14, 2014, and hereby incorporated by reference in its entirety.

FIELD OF THE INVENTION

This invention relates to control of hot water heaters.

BACKGROUND

Conventional operation of a tank type water heater is well known. Water in the water heater tank is typically maintained at a relatively high temperature (e.g., 140° F.) by a simple control system that runs the heater element when the tank temperature is too low and turns the heater element off when the tank temperature is high enough. This arrangement can lead to relatively high standby losses, because the water tank temperature is always high, even during times when little or no hot water is needed, e.g., while house occupants are away or asleep.

Efforts have been made to alleviate this issue by controlling the water heater to account for demand, such that the heating element can be turned off in periods when there is no demand. U.S. Pat. No. 8,461,493 and US 2013/0299600 are representative examples of this approach. In these references, hot water demand is measured by monitoring the output from the water heater.

SUMMARY

We have found that hot water heater control can be further improved by departing from the conventional approach of monitoring hot water demand at a single point (i.e., the water heater output). Instead, hot water demand is monitored at each location in the building where hot water is used. With this Smart Water Heater Controller (SWHC) approach, the controller can provide hot water at a temperature suitable for the intended use, e.g., warm water for a bath or shower, and much hotter water for a dishwasher. This advantageously avoids inefficiency due to mixing hot and cold water at a tap to provide temperature control.

An exemplary embodiment of the invention is apparatus for controlling a hot water heater, where the apparatus includes:

1) one or more point of use sensors disposed at use locations where water is provided, where each point of use sensor provides a location-specific temperature measurement of the water that is provided at its use location; and
2) a water heater controller configured to automatically control a temperature of water in a water heater tank of a water heater via control of a heating element of the water heater.

The water heater controller is configured to automatically derive a standard hot water usage model from previously acquired hot water usage data. The water heater controller is further configured to make use of previously acquired location-specific temperature measurements to set the temperature of water in the water heater tank.

In this manner, warm water can be efficiently provided at times when there is no need for hotter water (e.g., at shower or laundry times when the dishwasher is not running). For example, the water heater controller can be configured to set the temperature of water in the water heater tank to between about 35 C and about 45 C at times when none of the use locations needs water that is hotter than 45 C according to the standard hot water usage model. The specific temperature numbers here are not critical for practicing the invention, and different settings are also possible for this warm water mode. For example, an alternative would be where the water heater controller is configured to set the temperature of water in the water heater tank to between about 30 C and about 40 C at times when none of the use locations needs water that is hotter than 40 C according to the standard hot water usage model.

The water heater controller can be configured to deactivate the water heater element at times when none of the use locations needs hot water according to the standard hot water usage model. In this way, energy can be saved by not running the hot water heater when it is not necessary to do so.

The water heater controller can be further configured to automatically account for one or more external information inputs such as: weather forecasts, utility demand schedules, and personal calendars of one or more users of the apparatus. The water heater controller can be further configured to account for the one or more external information inputs by overriding the standard hot water usage model as needed. In this way, the system can automatically account for deviations from normal routines, such as an earlier wake-up time than normal on a personal calendar.

The standard hot water usage model can include location-specific models of standard hot water usage at each of the use locations.

The water heater controller can be further configured to automatically derive a model of heat loss and heating characteristics of the water heater. For example, the time constants for temperature increase during heater element operation and for temperature decrease during heater element non-operation can both be automatically derived. Once these time constant parameters are known, water heater control can automatically make use of them as needed. For example, providing hot water at time T0 will require activation of the heater element at a time prior to T0 that depends on the heating time constant and on the present and desired temperatures.

Preferably, one or more of the point of use sensors communicate with the water heater controller via wireless communication. More preferably, all of the point of use sensors employ wireless communication.

Preferably, one or more of the point of use sensors are configured to harvest energy for their operation from hot water pipes. More preferably, all of the point of use sensors are powered via energy harvesting from hot water pipes. Energy storage devices can be used to provide power to the point of use sensors at times when energy harvesting from hot water pipes cannot be employed. Such energy storage devices can be configured to recharge when energy harvesting from hot water pipes can be employed.

The standard hot water usage model can be a statistical model of probability of a water draw vs. time. Further parameters that can be included in the usage model are expected water draw volume and expected water draw temperature.

This approach is unique in its ability to determine and regulate the temperature of the water inside the tanked water heater based on point of use temperature measurements. The system is capable of actively monitoring and recording the homeowner's water usage patterns and environmental conditions. The following features are especially significant.

1. Building Characteristic Determination.

This system is able to autonomously determine characteristics of the house and water heater without any user interaction. Through active data collection, the algorithm is able to calculate the heat loss characteristics of the water heater and heating behaviors of the water heater. The algorithm is able to calculate these characteristics without forcing the homeowner to interact with the system. This allows ease of use to the user and does not affect the comfort level of any user in the house.

This approach uses sensors located around the house to provide a more customizable energy consumption. Other products on the market collect data at a single data collection hub. This forces those systems to assume all locations in the house are similar. However, by having sensors strategically placed around the house, the system will be provided with the right information for that exact location. The number of sensors necessary depends on the number of hot water appliances and faucets located in the house.

Information can also be collected using the Internet and Cloud to access third party information. This includes local weather, homeowner's calendar, and utility company power management sites. Weather information can affect when users will be needing hot water and the temperature the users would prefer the water. The homeowner's calendar and personal information can help customize user demands. Lastly, the system can work in conjunction with utility company demands to consume the least amount of energy during peak energy times or when utility companies charge a higher price per kilowatt hour.

2. Usage Pattern Determination.

The SWHC is able to eliminate more standby losses than current water heater controllers. This is achieved by the SWHC ability to more accurately track homeowner's hot water demands. Pre-programmed controllers turn off the water heater during unneeded times of the day. This system provides only a rough estimation of when the user will not be needing hot water and usually only turns the water heater off when the homeowner is sleeping or at work. The SWHC can understand to within a couple minutes of when the user will need hot water. This allows the water heater to enter standby mode throughout the day. In addition, the SWHC is able to change when it enters standby mode depending on outside influences. By syncing with the homeowner's calendar and planners, the controller will know when hot water will be needed that specific day. Every day the controller could have a different standby mode setting which saves much more energy as compared to a pre-programmed controller, which remains constant day-to-day.

By collecting user information, the algorithm is able to accurately predict when the next hot water draw will be needed and will plan accordingly. If a user's habits change, this system will be able to adapt accordingly.

3. Demand Driven Temperature Control.

The SWHC preferably uses active temperature control heat water to heat water to the exact temperature needed for the application. It can be accurate to within 0.5° C. of maintaining the desired temperature. A standard water heater will always heat to an excessively high temperature for all applications. The SWHC will know based on prior knowledge as to what temperature the application requires. While some applications will need very high temperatures like the dishwasher to sanitize dishes, most applications like a shower can use a much lower temperature. By lowering the temperature inside the water heater during water draws, the heating elements do not need to be on as long; thereby reducing energy consumption further.

DETAILED DESCRIPTION

Figure 1:
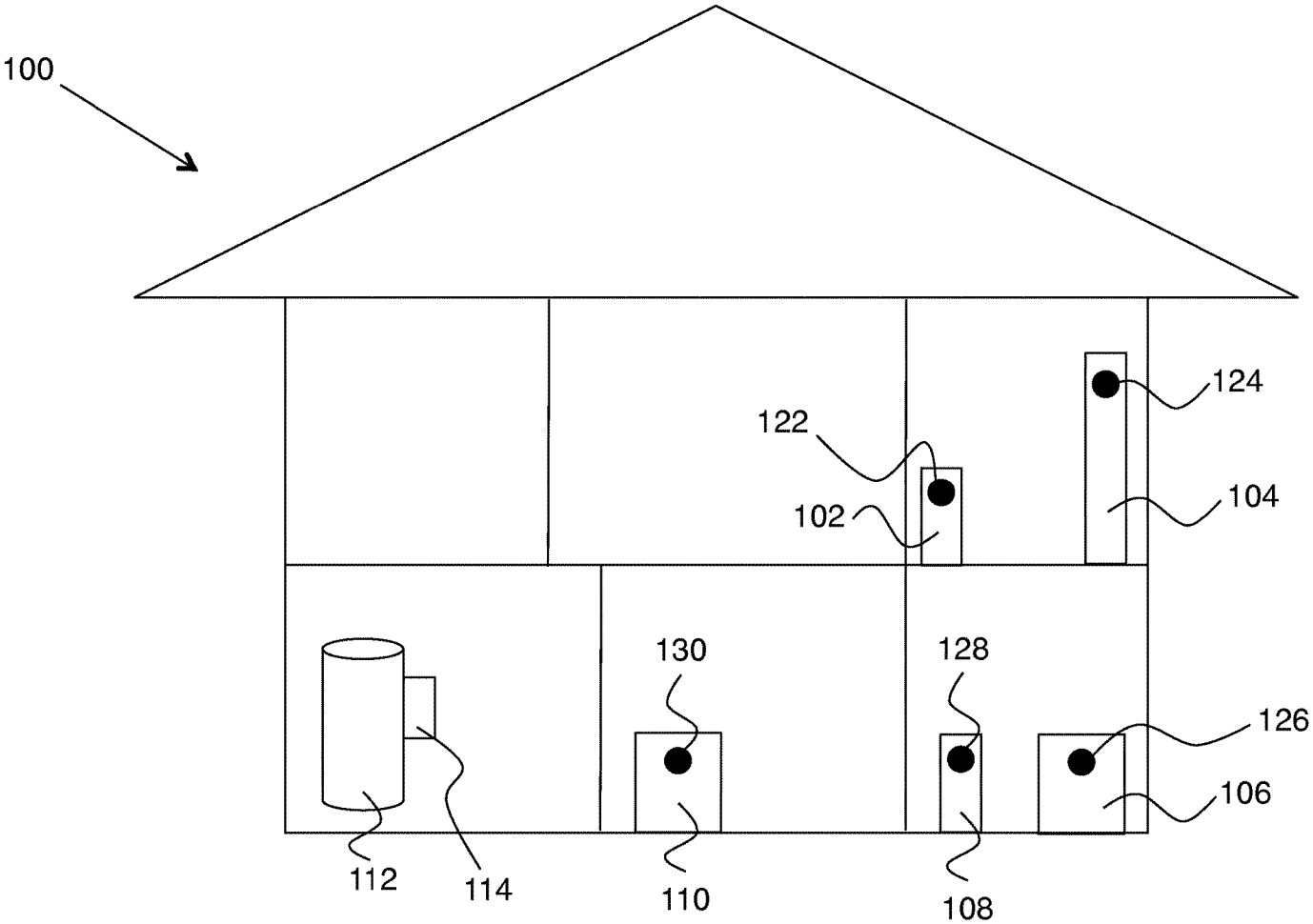
FIG. 1 schematically shows a system concept relating to embodiments of the invention.

FIG. 1 schematically shows a smart water heater controller (SWHC) system concept relating to embodiments of the invention. In this example, building 100 includes several use locations where hot water is used: bathroom basin 102, bath/shower 104, dishwasher 106, kitchen sink 108 and clothes washer 110. Each of the use locations has a corresponding point of use sensor. More specifically, point of use sensors 122, 124, 126, 128 and 130 correspond to use locations 102, 104, 106, 108 and 110 respectively. Each point of use sensor provides a location-specific temperature measurement of the water that is provided at its use location. It is important to note that these temperatures are measured at the final outputs of the relevant plumbing fixtures, as opposed to measuring temperature at the hot water inlets to the relevant plumbing fixtures.

The SWHC system also includes a water heater controller 114 configured to automatically control a temperature of water in a water heater tank of a water heater 112 via control of a heating element (not shown) of the water heater. As indicated above, water heater controller 114 is configured to automatically derive a standard hot water usage model from previously acquired hot water usage data, and to make use of previously acquired location-specific temperature measurements to set the temperature of water in the water heater tank.

The main objective of the SWHC system is to decrease the amount of energy consumed by residential water heaters. The SWHC system is compatible with existing tanked water heaters and hot water pipes. The energy reduction will be a result of two operations at work.

1. Conventional tank-type water heaters maintain a high water temperature at all times of the day. Due to the temperature difference between the hot water in the tank and the cooler ambient air temperature, heat loss occurs through the walls of the tank. This heat loss through the tank is called standby loss. While well insulated water heaters reduce the amount of heat loss, these water heaters tend to be much more expensive and require more ozone depleting insulation during manufacturing. The SWHC system works to reduce these standby losses. When hot water is not needed by the user, the system will shut off the power going to the heating elements therefore preventing any unnecessary heating. The system will keep the water temperature inside the tank at a low temperature until the program tells the system that hot water will be needed shortly and the heating element should turn back on. The system will then heat the water and be ready for the user when hot water is needed. Rather than keeping water at a high temperature, which causes larger heat losses, the system will maintain a low water temperature. This device will allow for the elimination of most standby losses at a much lower cost and with more environmentally friendly manufacturing process than buying a new higher insulated water heater.

2. The SWHC system will enact an active temperature control. A water heater usually heats water to around 60° C.; however, most applications around the house can suffice at much lower temperatures, usually around 42° C. In order for the water to get to this desired temperature, the extremely hot water must be mixed with cold water at the faucet. Rather than heating water to an excessive temperature then cooling it back down, the system will learn the desired temperature of the user for different applications and only heat the water high enough for that application. This allows the hot water to go directly to the user without being mixed with cold water. In turn, the energy consumed in heating water to temperatures above the desired temperature will be eliminated.

The SWHC can include a control system console (CSC) that is directly connected to the heating controls of an electric (or gas), tanked water heater. The control system optimizes energy reduction in a standard water heater. In order to reach this energy reduction, an artificial intelligence algorithm is implemented that learns from the household users. The algorithm clusters patterns of the users' habits. It then governs a switch in the control system, which regulates the time when the heater turns on as well as the temperature achieved in the tank. The system does not use a closed form analytic solution, but rather a data collection system that statistically determines the heating cycle in the water heater.

In order to gather all necessary information to effectively control the water heater, remote wireless sensors network (WSN) can be positioned at strategic hot water appliances and plumbing (i.e. dishwasher, washing machine, sinks, showers, etc.). The WSN collects water temperature information and sends it to the water heater controller. The sensors in the WSN actively communicate the water temperature data they collect with the control systems console attached to the water heater.

The SWHC is designed to operate off of an artificial intelligence software program. The control console attaches to the domestic water heater and interacts with its heating elements. This allows the controller to heat the water to a specific temperature at a specific time depending on the users' needs. Sensors on the console measure water flow, temperatures inside the hot water tank, and the ambient air temperature. The control console housing preferably allows the controls console and its various sensor and electronic components to be easily accessed when necessary. The controls console can include a microcontroller, a secure housing, and all other necessary components. The console is responsible for collecting the data via wireless communication, compiling the data, and controlling the heating elements of the water heater.

Figure 2A:
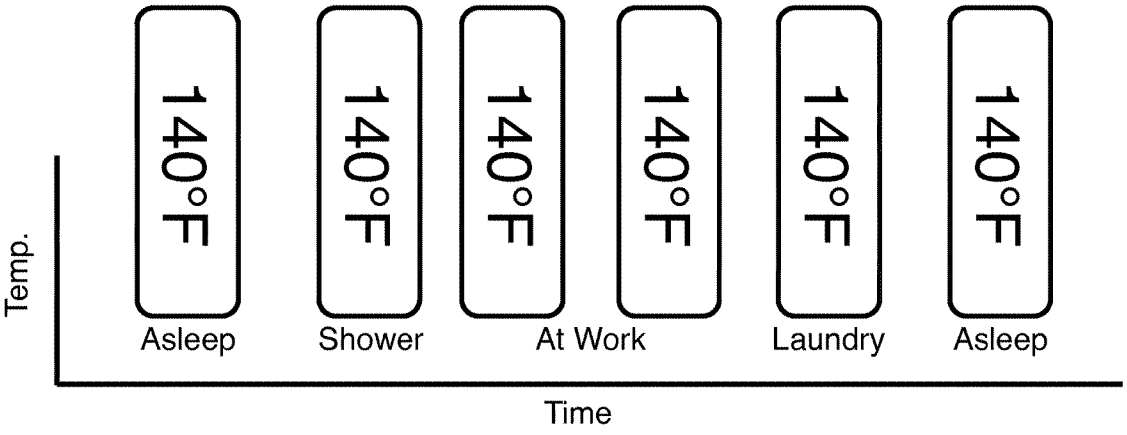
FIGS. 2A-B show a comparison of conventional water heater operation to water heater operation according to this work.
Figure 2B:
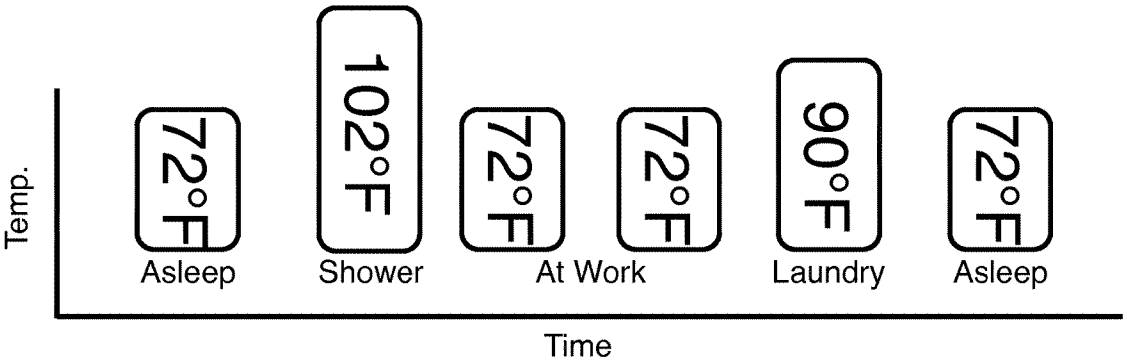

FIGS. 2A-B show a comparison of conventional water heater operation to water heater operation according to this work. FIG. 2A shows the inefficiency inherent in conventional fixed-temperature control of a water heater, where the water heater tank temperature is the same at all times. FIG. 2B shows how water heater tank temperature can be varied according to the needs of specific uses of hot water at various times, thereby reducing energy loss from the system.

Figure 3:
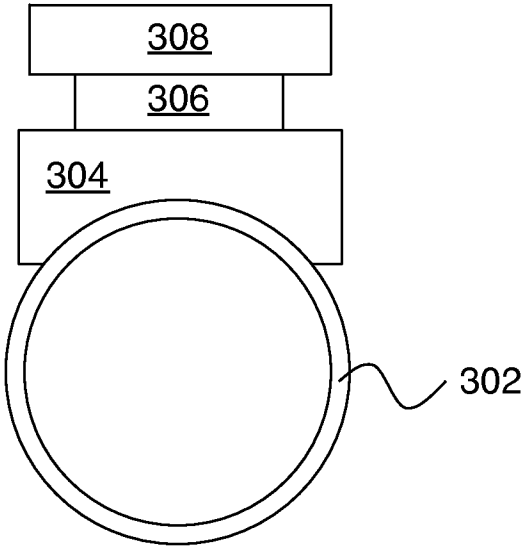
FIG. 3 shows an exemplary configuration for energy harvesting from a hot water pipe.

FIG. 3 shows an exemplary configuration for energy harvesting from a hot water pipe. Here 302 is a hot water pipe, 304 is a mounting block for making secure mechanical and thermal contact to pipe 302, 306 is a thermo-electric generator (TEG) and 308 is a heat sink. The temperature difference between mounting block 304 and heat sink 308 can be used to provide power to a nearby point of use sensor (not shown). In one worked design example, the TEG is capable of providing about 60 mW of power, while the point of use sensor needs 46 mW when active and <1 mW when inactive.

Figure 4:
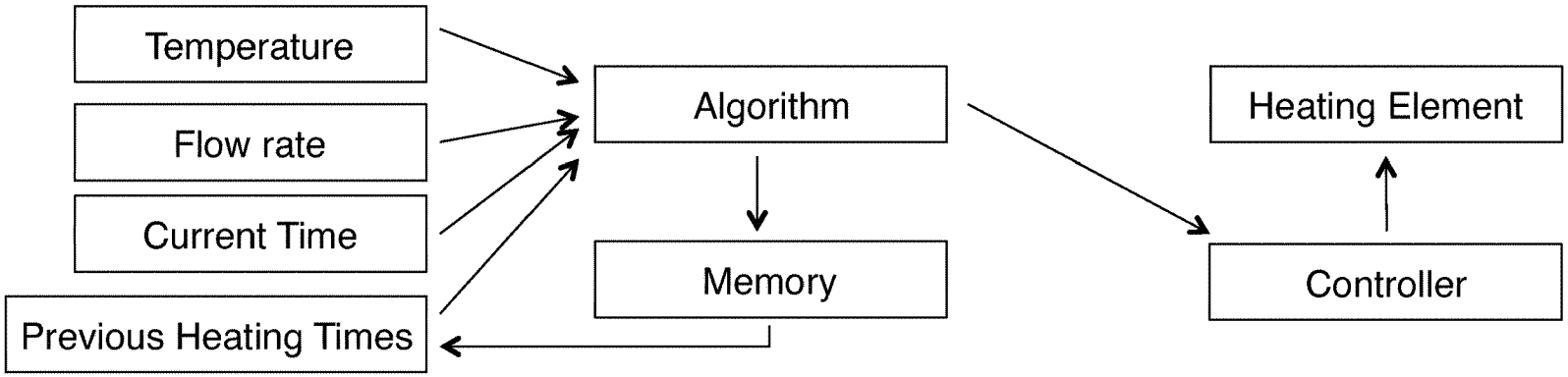
FIG. 4 shows a block diagram relating to water heater control according to this work.

FIG. 4 shows a block diagram relating to water heater control according to this work. The main idea here is to automatically learn the typical usage pattern for hot water in as much detail as possible. This will advantageously reduce, or even eliminate entirely, the need to manually program aspects of system operation. Known techniques from data analysis are expected to be applicable here, including machine learning, pattern recognition, cluster recognition, and big data analysis.

The user interface developed for the system allows the homeowner to interrupt the autonomous algorithm. This feature is relevant during irregular water draws. This would include when guests are staying at the house so the demand goes up, or when the user goes on vacation, in which case the demand goes down. Another possibility is when the user knows that he will be drawing water at a time when he usually does not. For example, if a user decided to come home during lunch to take a quick shower, the user could notify the system via the mobile app to start heating water while the user is driving home.

Figure 5:
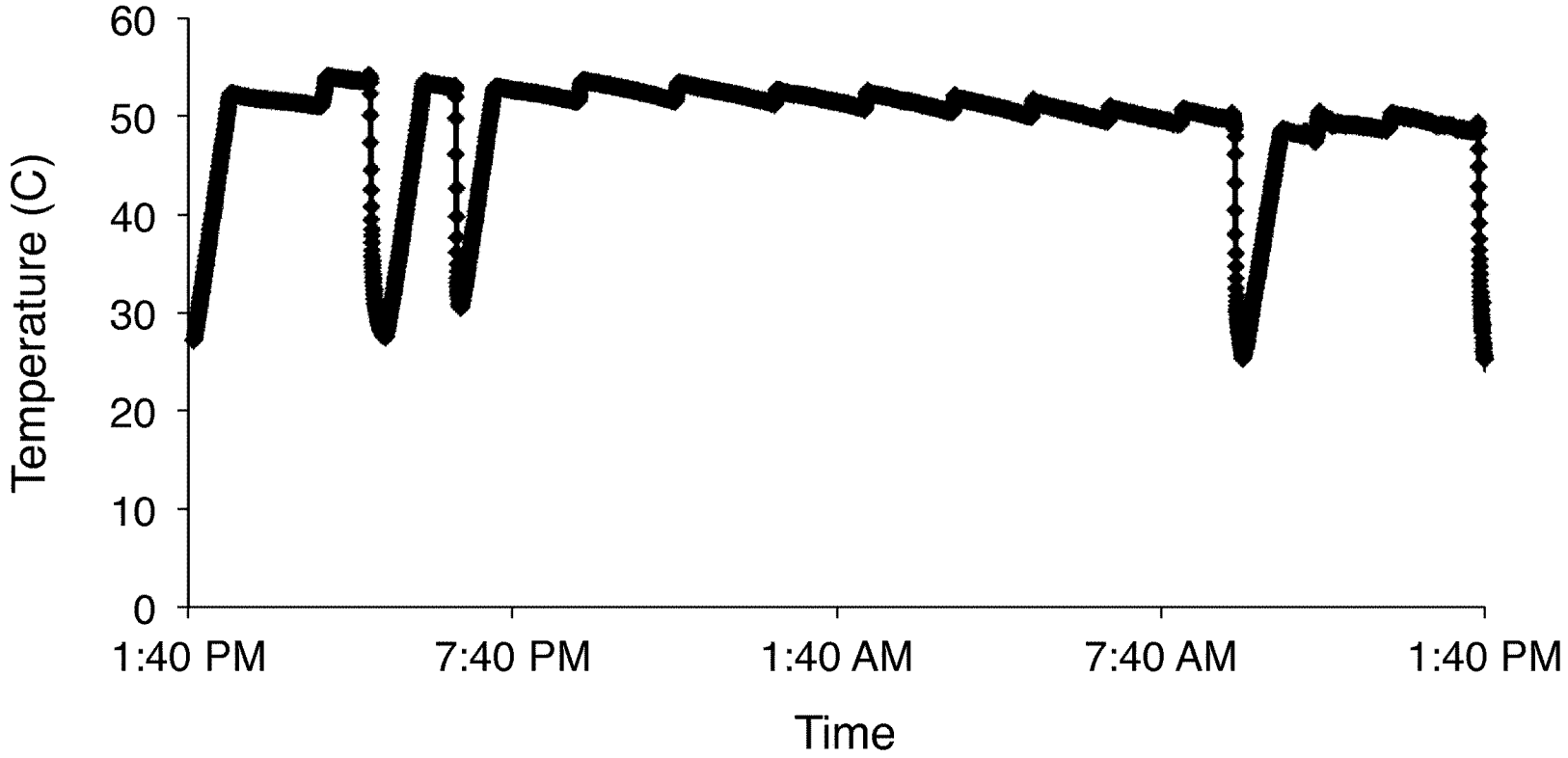
FIG. 5 shows exemplary temperature vs. time data for a conventionally controlled water heater.

FIG. 5 shows exemplary temperature vs. time data for a conventionally controlled water heater. Here we see that water heater tank temperature is generally maintained at a high temperature, with brief downward temperature spikes at times of hot water draws.

Figure 6:
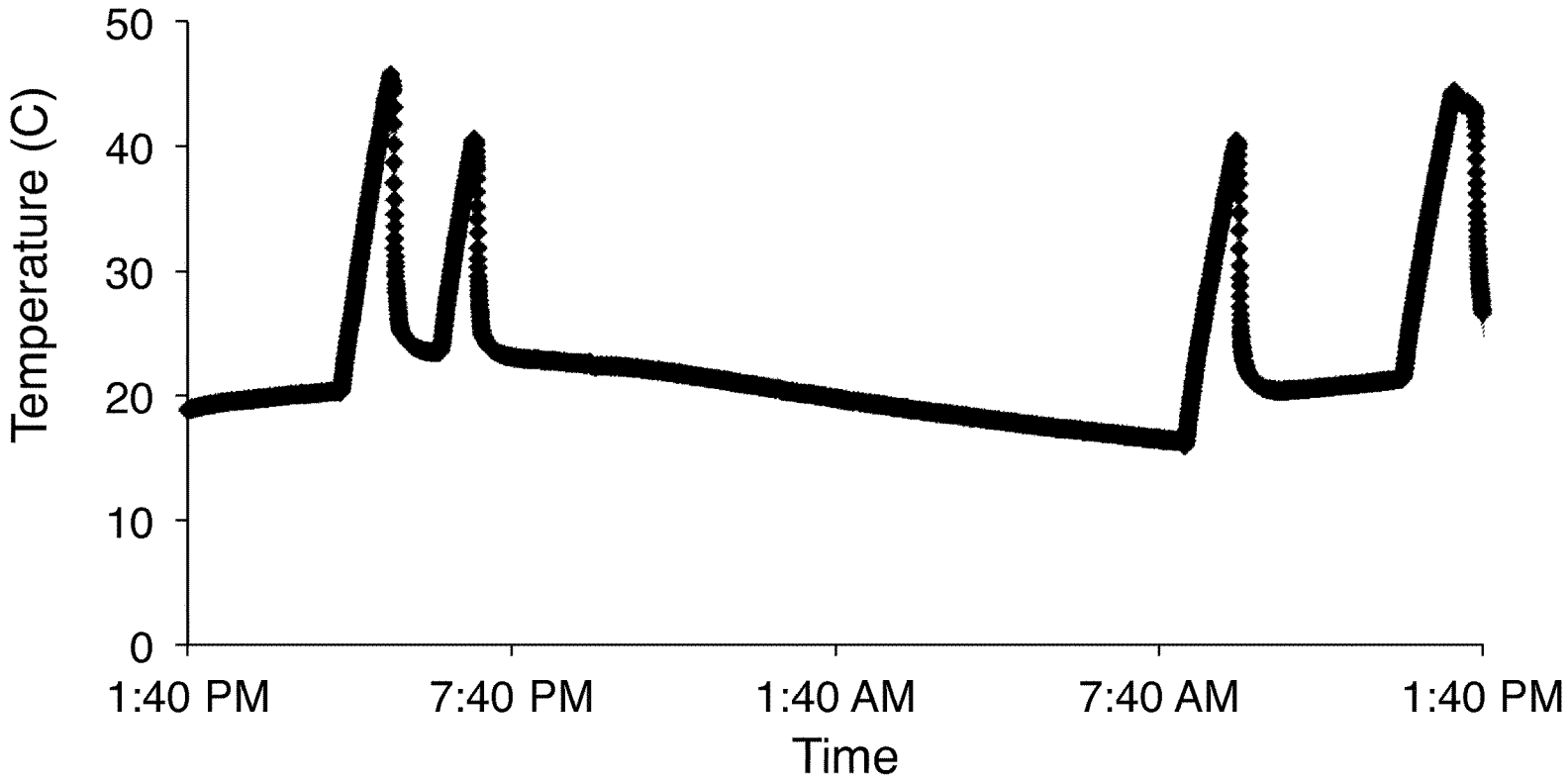
FIG. 6 shows exemplary temperature vs. time data for a water heater controlled according to this work.

FIG. 6 shows exemplary temperature vs. time data for a water heater controlled according to this work. Here we see that water heater tank temperature is generally maintained at a low temperature, with brief upward temperature spikes at times of hot water draws.

Figure 7:
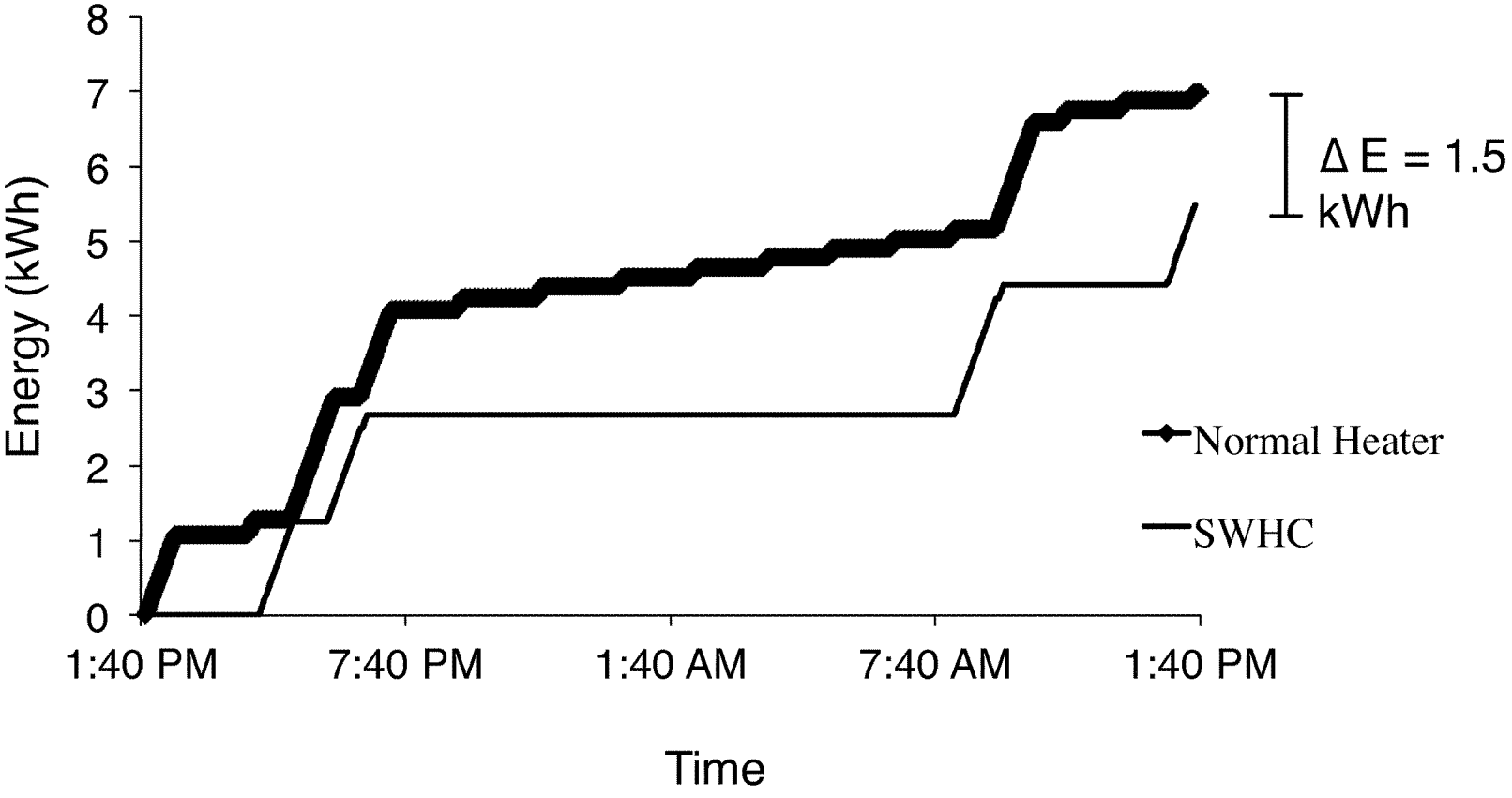
FIG. 7 shows estimated energy use for the cases of FIGS. 5 and 6.

FIG. 7 shows estimated energy use for the cases of FIGS. 5 and 6. The smart water heater controller (SWHC) approach of FIG. 6 is seen to provide an energy savings of 1.5 kWh in a 24 hour time period in this example.

Figure 8A:
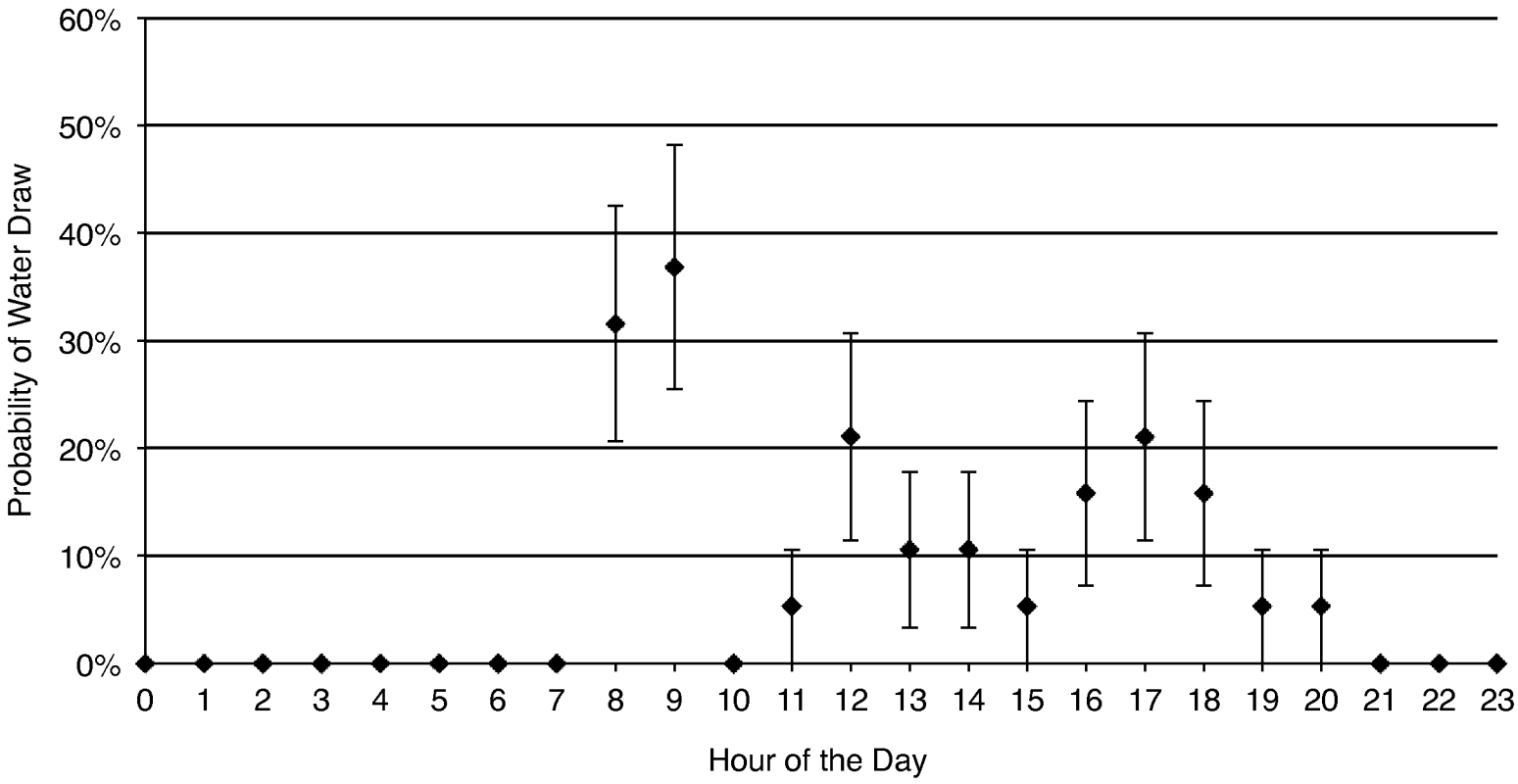
FIGS. 8A-C show an exemplary standard usage model for hot water use.
Figure 8B:
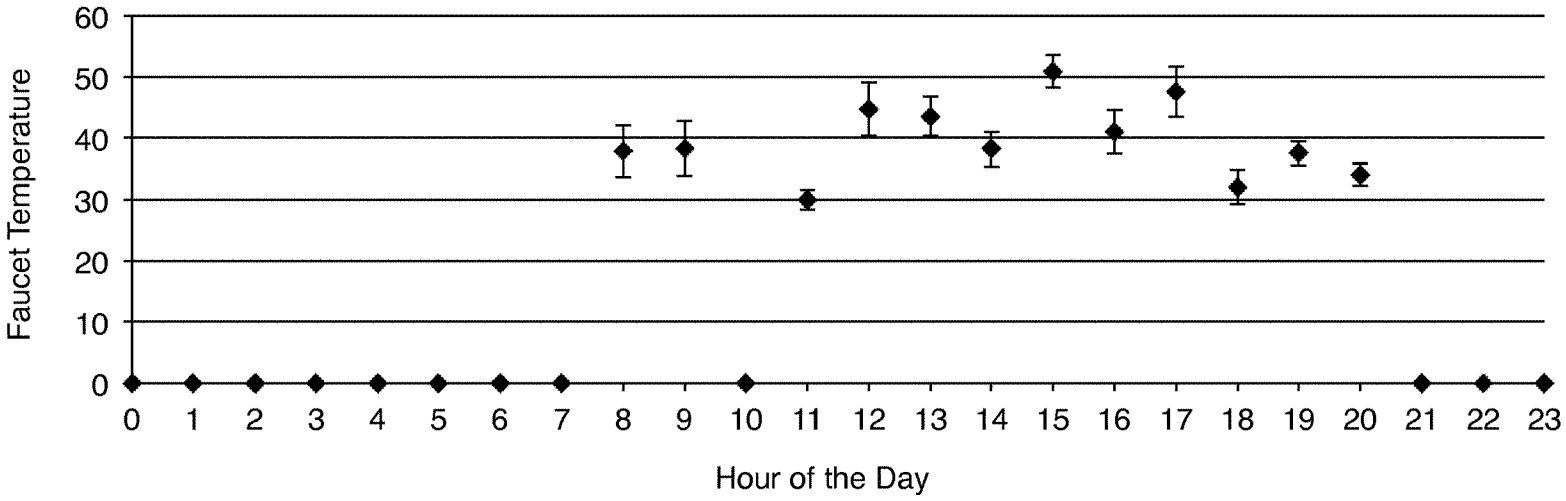
Figure 8C:
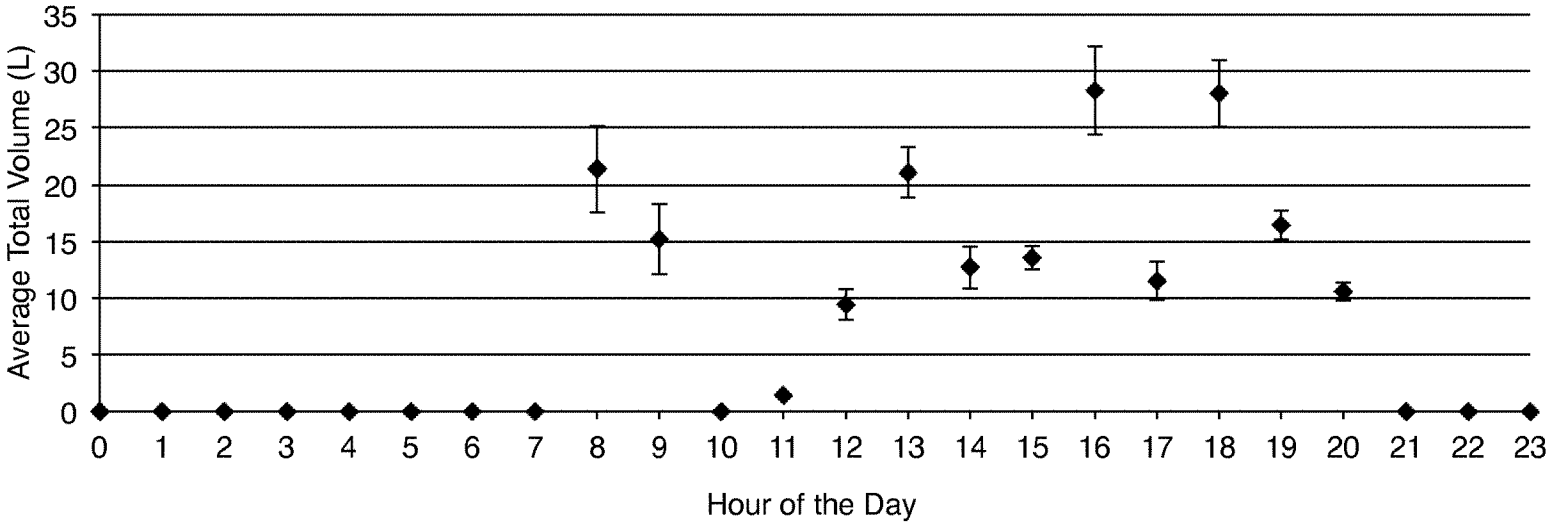

FIGS. 8A-C show an exemplary standard usage model for hot water use. This standard usage model includes values for the probability of a water draw (FIG. 8A), faucet temperature of the water draws (FIG. 8B) and average draw volume (FIG. 8C).

Although the previous examples mainly consider residential applications, this technology can also be scaled to improve energy efficiencies at a building level system. Rather than apply the algorithm to appliances, the algorithm would be applied to a building at large. The system would be capable of interacting with multiple systems within the building to optimize energy efficiencies and reduce consumption of water and electricity.

To better appreciate the present SWHC approach, we compare it to several alternatives that have been demonstrated or proposed. The products that are currently competing with the SWHC are: water heaters that are already on the market, tankless water heaters, and products that use data collection to control household appliances. In addition, a product design specification (PDS) was created to compare the smart controller aspect of the SWHC to a water heater timer controller and to a water heater with no time controller.

Benchmark: Water Heater Control Systems.

One competing technology to the SWHC is a pre-programmed water heater controller such as the Intermatic EH10, 120 Volt, timer control system. This product is currently available on the market. It is a switch that allows users to control for limited times when they want to turn off their electric water heaters. The timers are able to be programmed for daily scheduling, repeat scheduling and workday or weekend scheduling. The user must manually set when the water heater is to be turned on. In addition, the product does not change to better match user demands. An analysis was conducted to see how the SWHC surpasses the energy and cost savings of a typical pre-programmable water heater controller like the Intermatic EH10. This information is summarized in Table 1 below.

TABLE 1

Design specifications for the SWHC as compared to other controller methods. Here ** signifies quantities that depend on the assumptions of: a standard 50 gallon electric water heater, and 12 cents per kWh electricity cost (US average).

| Parameter | Units | Design Criticality | Smart Water Heater Controller | Timer control system Intermatic EH10 (120 V) | No controller |
|---|---|---|---|---|---|
| Size | Cubic meters | High | Max: 0.125 | 0.0019 | 0 |
| Weight | kg | Medium | Max: 1.5 | 1.4 | 0 |
| Lifetime | Years | High | 13 | 3 | 0 |
| Material | | Medium | Acrylic | Drawn steel | N/A |
| User Interface | | Low | Phone App | Manual time switches | None |
| Installation Time | Hours | High | 0.5 | 0.5? | 0 |
| Outlet Temperature | ° C. | High | 60 | 60 | 60 |
| Temperature Control | ° C. | High | Yes | No | No |
| Product Price | US Dollars | High | $250 | $60-$85 | 0 |
| Operating Cost | US Dollars/year | High | 2.10 | 0 | 0 |
| Daily Standby Savings** | kWh | High | 1.5 | 0.167 | 0 |
| Daily Standby Savings** | $ | High | 0.18 | 0.02 | 0 |
| Daily Temperature Control Savings** | kWh | High | 1.5 | 0 | 0 |
| Daily Temperature Control Savings** | $ | High | 0.18 | 0 | 0 |
| Annual Energy Savings** | kWh | High | 1095 | 60.96 | 0 |
| Annual Monetary Savings** | $ | High | 128.46 | 7.30 | 0 |
| Net Energy Savings over Lifetime** | kWh | High | 14235 | 182.86 | 0 |
| Net Monetary Savings over Lifetime** | $ | High | 1670.00 | 21.90 | 0 |

Benchmark: Tankless Water Heaters.

Tankless water heaters are another option for household water heating. Depending on the user demands, the tankless water heater can consume either more or less energy than a typical tanked water heater. Tankless water heaters only heat water when it is needed, but they are much less efficient at heating water. A tanked water heater allows all the heat generated from the heating coil to go into heating the water since the coil is completely submerged in water. However, a tankless heater loses some of the work put into heat the coils into the surroundings due to a poor thermal contact between the water and the heating coil. In addition, tankless water heaters have a much higher upfront cost that can take up to 20 years to pay back in energy savings. Lastly, some houses are not equipped with the proper gas inlet capacity to effectively operate such a system.

Benchmark: Neurio®—Smart Energy Awareness.

The Neurio® was developed by a smart energy company called Energy Aware in Vancouver, Canada. This sensor allows people to monitor their energy usage through an app that can be downloaded to a phone. The sensor is installed in the breaker panel of the home appliance and sends data to a cloud which then transmits the data to the viewing device. It has the capability to report real-time power usage and can tell users when something was left on. It also can tell users how much energy they are using.

Benchmark: Nest Learning Thermostat.

Another company that is working on this type of home control system is Nest Labs. This company has developed a device called the Nest, which learns a home space heating and cooling schedule, programs itself, and can be accessed via a mobile phone. It connects to the existing thermostat hookup in a person's house. The system spends the first week learning user's temperature preferences and then builds a schedule based on this data. However, the Nest only has one central console to collect all necessary information. In contrast, the SWHC relies on remote sensors for data collection, which gives it more information on specific locations in the house. In addition, the Nest requires user inputs to create the heating schedule. In order to collect the patterns of the homeowner, the system must constantly request the user to put in their inputs during the learning stage of the algorithm. It does this by lowering the temperature during times of the day so the user will come turn the thermostat back up. The SWHC system differs in that it is completely care free. It never asks the user for inputs but rather learns the user preferences through data collection and monitoring.

Major cost savings for the Smart Water Heater Controller can be attributed to the energy saved by reducing heat lost to the environment and using active temperature control. From preliminary testing, it was determined that the system will save about 89 kWh/month which equates to a monetary saving of $10.68/month if the average price per kilowatt hour throughout the United States of 12 cents per kWh is used.

Standby losses, if eliminated can save about 1.5 kWh a day. This value was determined experimentally by running two tests. The first test was with a 10 gallon electric water heater that was automatically controlled to keep water at about 60° C. During a 24 hour period, 4 water draws were taken at different times of the day. Throughout this test, the energy usage of the heater was tracked. This first test simulated a typical water heater and was taken to be the control. The second test involved keeping the heating element off except for the 45 minutes leading up to a water draw. The same heater was used with the same 24 hour time period and the same times for hot water usage. The only thing that was changed was the manual heating of the water. The energy usage difference between these two situations was found to be 1.5 kWh. See FIGS. 5-7.

Testing energy savings for temperature control used more assumptions. This savings was found through comparing the amount of energy used to heat up water up to 50° C. as compared to 60° C. This difference was found to be about 0.5 kWh. It was assumed that if the average household chose to use 50° C. water instead of 60° C. water three times a day, then another 1.5 kWh of energy would be saved every day. This value, combined with the energy savings through standby losses would amount to around 89 kWh a month. If this amount of savings last throughout our expected lifetime of our system, which is 13 years, than the system will be able to save about $1670 throughout its lifetime.

Most importantly, buying this system would prevent the user from spending more money to buy a newer water heater with a much higher insulation. Although these new water heaters are much more efficient than current water heaters, the Smart Water Heater Controllers bridge the gap between the two and has the ability to make older outdated water heaters as efficient as newer models.

The invention claimed is:

1. Apparatus for controlling a hot water heater, the apparatus comprising:

one or more point of use temperature sensors disposed at final outputs of plumbing fixtures;

wherein the plumbing fixtures are configured to dispense water to a user or to an appliance;

wherein each point of use temperature sensor is configured to provide a dispensed-water temperature measurement of water that is dispensed from the plumbing fixture; and a water heater controller configured to automatically control a temperature of water in a water heater tank of a water heater via control of a heating element of the water heater;

wherein the water heater controller is configured to automatically derive a standard hot water usage model from previously acquired hot water usage data and from previously acquired dispensed-water temperature measurements;

wherein the water heater controller is further configured to make use of the standard hot water usage model to set the temperature of water in the water heater tank.

2. The apparatus of claim 1, wherein the water heater controller is configured to set the temperature of water in the water heater tank to between about 35 C and about 45 C at times when none of the use locations needs water that is hotter than 45 C according to the standard hot water usage model.

3. The apparatus of claim 1, wherein the water heater controller is configured to set the temperature of water in the water heater tank to between about 30 C and about 40 C at times when none of the use locations needs water that is hotter than 40 C according to the standard hot water usage model.

4. The apparatus of claim 1, wherein the water heater controller is configured to deactivate the water heater element at times when none of the use locations needs hot water according to the standard hot water usage model.

5. The apparatus of claim 1, wherein the water heater controller is further configured to automatically account for one or more external information inputs selected from the group consisting of: weather forecasts, utility demand schedules, and personal calendars of one or more users of the apparatus.

6. The apparatus of claim 5, wherein the water heater controller is further configured to account for the one or more external information inputs by overriding the standard hot water usage model as needed.

7. The apparatus of claim 1, wherein the standard hot water usage model includes fixture-specific models of standard hot water usage at each of the plumbing fixtures.

8. The apparatus of claim 1, wherein the water heater controller is further configured to automatically derive a model of heat loss and heating characteristics of the water heater.

9. The apparatus of claim 1, wherein one or more of the point of use temperature sensors communicate with the water heater controller via wireless communication.

10. The apparatus of claim 1, wherein one or more of the point of use temperature sensors are configured to harvest energy for their operation from hot water pipes.

11. The apparatus of claim 1, wherein the standard hot water usage model includes a statistical model of probability of a water draw vs. time.

* * * * *